US005641232A

United States Patent [19]

Frey

[11] Patent Number: 5,641,232

[45] Date of Patent: Jun. 24, 1997

[54] PORTABLE BALL WASHER

[76] Inventor: Michael Carl Frey, 6620 372nd St., North Branch, Minn. 55056

[21] Appl. No.: 491,722

[22] Filed: Jun. 19, 1995

[51] Int. Cl.[6] ..... A63B 47/04

[52] U.S. Cl. ..... 401/11; 401/202; 401/207; 15/104.92

[58] Field of Search ..... 401/9, 10, 11, 401/202, 206, 207; 15/104.92

[56] References Cited

U.S. PATENT DOCUMENTS

| | | | |
|---|---|---|---|
| 1,506,305 | 8/1924 | Kelly | 401/202 X |
| 1,710,816 | 4/1929 | Evans | 15/104.92 |
| 2,608,705 | 9/1952 | Duff | 401/11 |
| 2,622,257 | 12/1952 | Lemonds et al. | 401/11 X |
| 2,624,900 | 1/1953 | Smith | 401/11 |
| 3,087,189 | 4/1963 | Scanlon | 401/11 |
| 3,124,828 | 3/1964 | Barber et al. | 401/202 |
| 3,256,551 | 6/1966 | Schwartzman | 401/206 |
| 3,453,675 | 7/1969 | Barton et al. | 15/104.92 |

*Primary Examiner*—Steven A. Bratlie

*Attorney, Agent, or Firm*—Peterson, Wicks, Nemer & Kamroth, P.A.

[57] ABSTRACT

A portable hand-held golf ball washer includes a washer fluid reservoir within a sealed housing, a concave portion overcovered with a moisture retaining pad, and a valve with a spring closure openable by pushing a ball into the pad to permit flow of washer fluid into the pad.

20 Claims, 2 Drawing Sheets

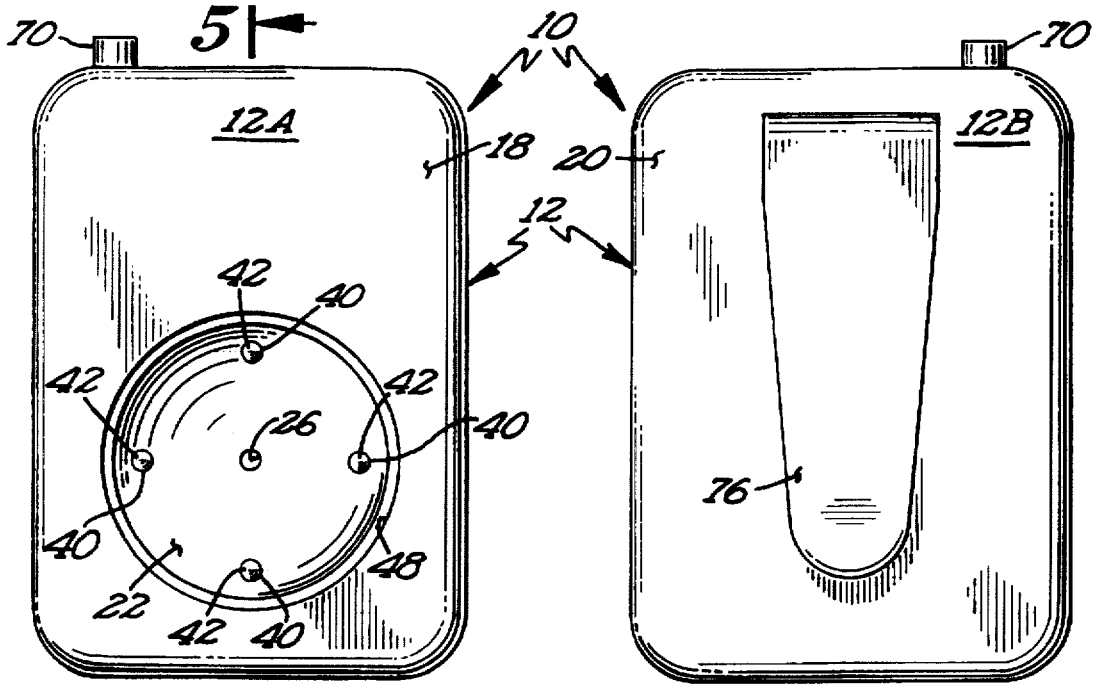
Fig 2
Fig 4
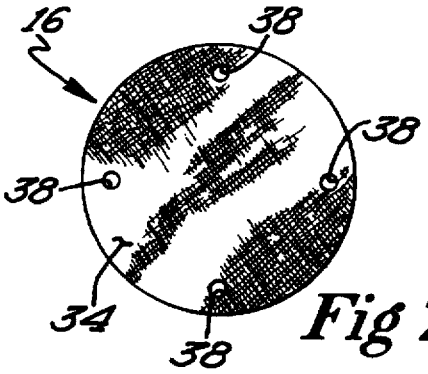
Fig 7
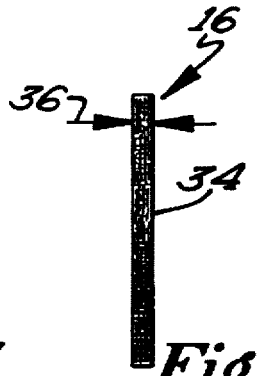
Fig 8
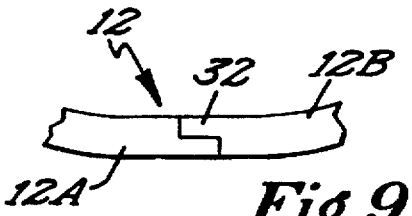
Fig 9
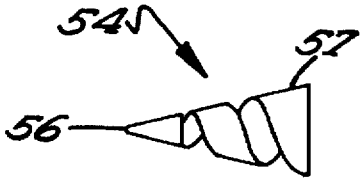
Fig 10

PORTABLE BALL WASHER

BACKGROUND OF THE INVENTION

This invention relates generally to a portable ball washer. More particularly, this invention pertains to a self-contained unit which may be carried conveniently on the belt or golf bag to serve as a ball washer for removing harmful fertilizers, toxic herbicides and pesticides, dirt, and stains from golf balls. The need for removing such materials from golf balls often occurs where a player has no ready access to a stationary ball cleaner or cleaning liquid.

Without cleaning, a golf ball is likely to move erratically when driven or putted, being unbalanced.

Furthermore, it is known that golfers sometimes lick a dirty ball with their tongue when a cleaning means is not readily available. The ingestion of toxic materials in this manner is a recognized hazard.

At the outset, it should be acknowledged that other portable golf ball cleaners are known. A toroidal type of cleaner containing sponge-like cleaning surfaces is described in U.S. Pat. No. 4,084,287 of A. E. Ingram and N. H. Ingram. The present invention is directed to an improved device having features and advantages not existing in previous devices.

BRIEF SUMMARY OF THE INVENTION

It is an object of the present invention to provide a portable golf ball washer which has a water-tight liquid reservoir casing to provide cleaning liquid to a sponge pad for quick, on-the-spot cleansing of toxic fertilizers and herbicides, grass stains and dirt from golf balls.

Another object of the invention is to provide a cleaning pad which conforms to the shape of the ball surface.

It is a further object to provide means for removing and replacing used, dirty and/or worn sponge pads.

Another object is the provision of a mechanism whereby cleaning liquid may be easily dispensed to the sponge pad during the cleaning process, i.e. while a golf ball is pressed against the sponge pad.

An additional object is to provide a golf ball washer which may be readily attached to a person's belt, a golf bag or golf cart.

It is a further object to provide a golf ball washer which may remain attached to a golfer's belt while playing, without hindering the golfer's play by distracting attention or blocking the swing and follow-through.

These and other objects and features of the invention are to found in the following description and claims wherein a description of the invention is set forth together with instructions which will enable one skilled in the art to make the invention, and including the principles of operation, all in connection with the best mode presently contemplated for the practice of the invention.

BRIEF DESCRIPTION OF THE DRAWINGS

Drawings of the invention have like reference numerals applied to designate like elements throughout the several views, wherein:

FIG. 2 is a reduced scale front view of a golf ball washer of the invention;

FIG. 4 is a reduced scale rear view of a golf ball washer of the invention;

FIG. 7 is a front view of a washing pad for a golf ball washer of the invention;

FIG. 8 is an edge view of a washing pad for a golf ball washer of the invention;

FIG. 9 is an enlarged scale sectional side view of the joint between front and rear portions of a golf ball washer of the invention, as taken along line 5—5 of FIG. 2; and FIG. 10 is a side view of a spring type valve for a golf ball washer of the invention.

DESCRIPTION OF THE ILLUSTRATED EMBODIMENTS

Figure 1:
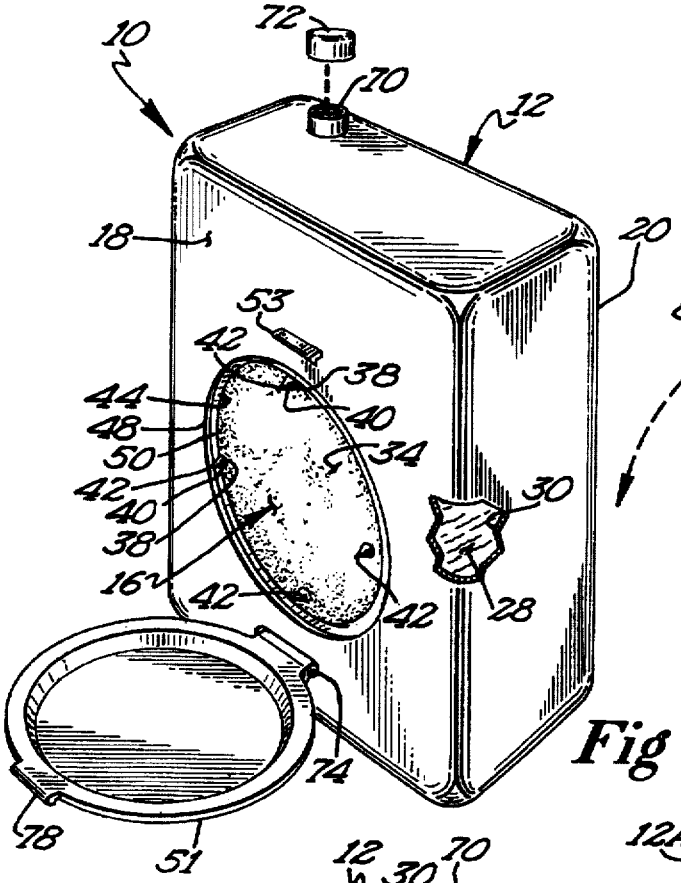
FIG. 1 is a perspective view of a golf ball washer of the invention.

With reference to the drawings of FIGS. 1–9, a portable golf ball washer 10 is shown which includes a housing 12 with a rounded concave portion 14 on the front face 18. A replaceable cleaning pad 16 is mounted across the concave portion to cover the concave portion. The housing 12 has a generally thin wall and may be formed, e.g. molded of plastic as a front housing portion 12A and a rear housing portion 12B. The front and rear housing portions 12A, 12B are sealingly joined to form the housing 12. The housing 12 is shown in a generally hexahedral shape with rectangular front face 18 and rear face 20.

As shown, the housing 12 may have rounded edges for purposes of strength and aesthetics. While the illustrated shape is preferred, other shapes are anticipated for making the housing 12. For example, the front and rear faces 18, 20 may be round, oval, triangular, or of other shape. The housing 12 may be made of any applicable durable plastic material which may be efficiently molded and is not affected by solvents used to clean a golf ball 8. One such plastic material is vinylite plastic which is easily molded, relatively inexpensive and commercially available in various attractive colors.

The exposed surface 22 of the concave portion 14 generally defines a spherical surface, typically being semi-spherical, i.e. a portion of a sphere, having a diameter 24 approximately equal or greater than the diameter 25 of a standard golf ball 8. The diameter 24 may be such that when a cleaning pad 16 is fully compressed against the concave portion by a ball 8, the resulting inside curvature of the pad 16 has a diameter substantially equal to the diameter 25 of the ball. Thus, a substantial portion of the pad 16 is in contact with the ball during the cleaning operation.

Figure 5:
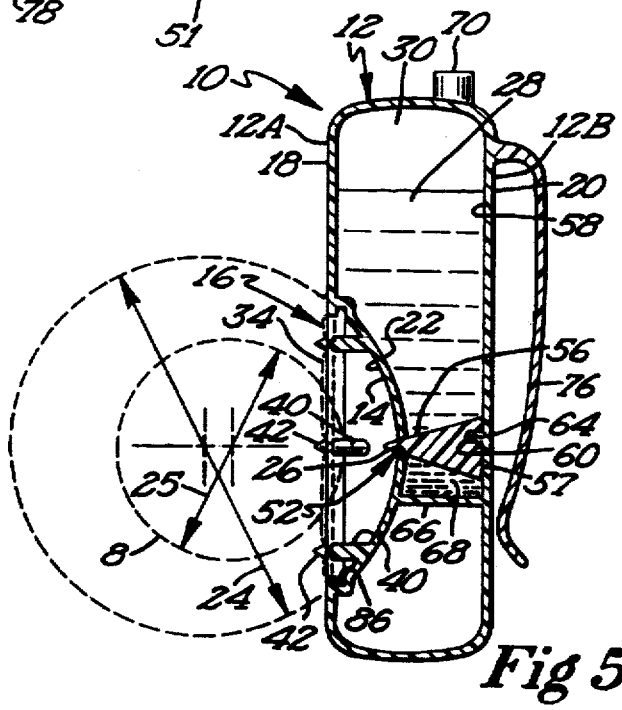
FIG. 5 is a reduced scale sectional side view of a golf ball washer of the invention, as taken along line 5—5 of FIG. 2.
Figure 6:
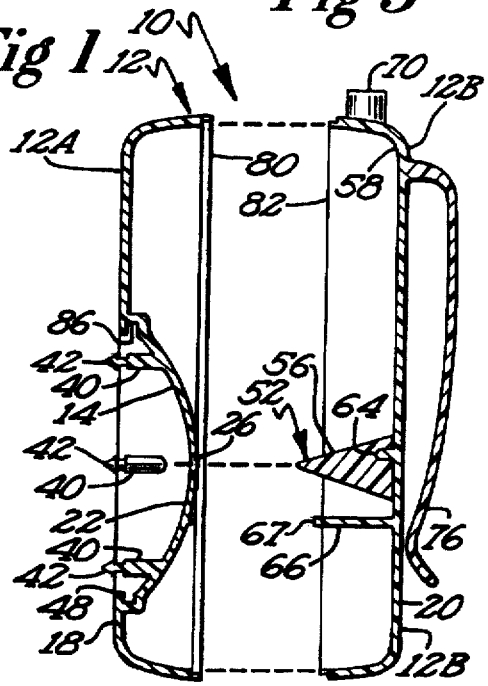
FIG. 6 is a reduced scale exploded sectional side view of a golf ball washer of the invention, as taken along line 5—5 of FIG. 2.

As shown in FIGS. 2, 5 and 6, a small fluid aperture 26 is located at or near the center of the exposed surface 22 and passes through the wall thereof for the flow of cleaning liquid 28 from a reservoir 30 formed within the front housing portion 12A and the rear housing portion 12B.

As shown in FIG. 6, the matching edges 80 and 82 of the front and rear housing portions 12A, 12B may be formed in a manner providing a telescoping or circumferential lap joint 32 as further shown in FIG. 9. The joint 32 may be sealed by adhesive, thermal treatment or other method. It is imperative that the joint 32 be sealed to prevent leakage of cleaning liquid 28 from the reservoir 30. Alternatively, a butt joint or other joint configuration may be used, provided it is leak-proof and does not adversely affect the operation of the washer 10.

The cleaning pad 16 is typically formed of natural or artificial sponge material, fiber mat or other material which will provide the proper surface friction, moisture absorption, flexibility and strength for easy cleaning of a golf ball. As shown in FIGS. 7 and 8, the pad 16 may have a round cleaning face 34; or other shape face to fit over the concave portion 14. The pad 16 preferably has a thickness 36 of less than 0.25 inch, and more preferably of about 0.02–0.15 inch. As shown, the pad 16 may have a plurality of attachment holes 38 spaced about the cleaning face 34. In one embodiment, male support pegs 40 with enlarged heads 42 project outwardly from the exposed surface 22. The heads 42 are passed through matching attachment holes 38 in the pad 16 to hold it in place. Thus, the pad 16 may be mounted over the concave portion 14 by aligning and pressing the pad onto the male support pegs 40.

As shown in FIGS. 1 and 2, a fastening ring 44 may be compressively mounted over the pad 16 to retain the edges of the pad against the outer periphery 48 of the concave portion 14. The fastening ring 44 may be held in the outer periphery 48, being snapped into a circular groove 86. The fastening ring 44 may be formed of plastic such as a vinylite material and is configured to retain the pad 16 over the concave portion 14 yet be easily removed by outwardly directed pressure. The fastening ring 44 also prevents leakage of cleaning liquid 28 past the pad 16. The fastening ring 44 provides an opening 50 through which a major portion or all of the outer diameter of a golf ball may be passed, to compressively engage the cleaning pad 16.

Figure 3:
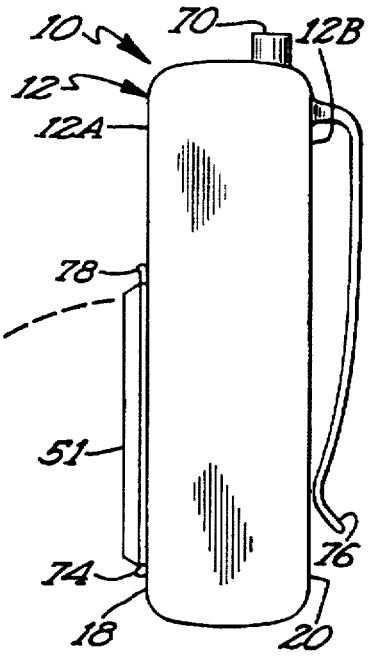
FIG. 3 is a reduced scale side view of a golf ball washer of the invention.

In a preferred form of the invention, a cap 51 covers the pad 16 when not in use, for reducing evaporation of the cleaning liquid 28 and for preventing the pad from unwanted contact with clothing or other items. The cap 51 is shown in FIG. 1 as being hinged to the front face 18 of the housing 12 at hinge 74. The cap 51 may be configured to snap onto a projection or detent 53 on the housing 12 for ease of use and is shown with a handle 78. Alternatively, the detent may be part of the fastening ring 44. As shown in FIG. 3, the cap 51 may be unsnapped from the housing 12 and rotated arcuately along path 84.

In one embodiment described herein, a valve 52 is activatable to permit the flow of cleaning liquid 28 from reservoir 30 through fluid aperture 26 to be absorbed by the cleaning pad 16 for cleaning golf balls.

As illustrated in FIGS. 5 and 6, the valve 52 utilizes the fluid aperture 26 as a valve seat. The valve 52 may be of hard rubber, or may be a spring 54 with a spring head 56 which is attached to the inside wall 58 of the rear housing portion 12B and extends into the fluid aperture 26 to generally seal it against liquid flow therethrough until it is activated. The spring head 56 is shown as conical so that when it is pushed rearward a short distance by a golf ball pressed into the pad 16, a small passageway is created for the flow of cleaning fluid 28 past the spring head 56 and into the pad 16.

The valve 52 may comprise a metal or plastic coil spring (FIG. 10) with a plastic head 56, or may be formed of a material which is longitudinally compressible, such as hard rubber rubber. Its compressibility must be such that it may be easily moved rearwardly by a user merely by pressing a golf ball 8 inwardly into the pad 16, yet not be openable by extraneous forces resulting from active body movement of the golfer.

As illustrated in FIG. 5 and 6, a conical valve 52 with head 56 is normally sealingly compressed into the fluid aperture 26. The valve 52 is formed as part of the inside wall 58 or is attached to the inside wall 58 by cementation thereto or by other means. In one embodiment, projections 60 are formed on the inside wall 58 for alignment with and passage into matching holes 64 in the base 57 of the valve 52. In this manner, the valve 52 is aligned with the fluid aperture 26 and the head 56 is snugly fitted into the fluid aperture 26 to prevent passage of cleaning liquid 28 except when the head 56 is pushed rearward by the pad 16 as a golf ball or e.g. finger is pressed into the pad. The head 56 and fluid aperture 26 may be conical in shape so that a slight rearward movement of the head 56 permits the flow of cleaning liquid 28 to the pad 16.

Although all of the internal space within the washer 10 may be useable as the reservoir 30 for cleaning liquid 28, one embodiment uses a wall 66 below the valve 52 to confine liquid 28 to the upper portion 68 of the washer 10 where it is readily available to the fluid aperture 26. If a wall 66 is used, its front edge 67 must be sealingly attached to the inner wall of the concave portion 14 during assembly.

As shown in FIG. 1, an inlet aperture 70 comprises a hollow apertured tab leading into the reservoir 30 for filling it with cleaning liquid 28. The inlet aperture may be closed by a removable water-tight cap 72. Alternatively, the inlet aperture 70 may simply be a hole which is sealed by a stopper, as known in the art.

The washer 10 is designed to hold a cleaning liquid 28 such as an aqueous solution of detergent. More preferably, the cleaning liquid 28 contains an organic solvent such as an alcohol which is quick drying, to enable play immediately after cleaning the ball. Commercial formulations of window cleaning fluids, including automobile washer fluids, may also be used.

In one form of the invention, shown in FIGS. 4, 5 and 6, an attachment clip 76 is attached to the rear housing portion 12B. This clip 76 may be made of e.g. plastic or metal for holding the ball washer 10 in a golfer's pocket.

In use, the washer 10 may be held vertically, e.g. attached to a belt, or simply handheld. Alternatively, the pad 16 may also be moistened by holding the washer 10 horizontally, front side down, while actuating the valve 52 to permit the flow of cleaning liquid 28.

As shown, the components of the entire golf ball washer, except where specifically stated otherwise, are shown in mirror symmetry about a vertical, median, longitudinal plane. Consequently, a description of the parts in one side serves equally to identify the parts in the opposite side. However, the washer may be formed in an asymmetrical manner without deviating from the invention.

It is anticipated that various changes and modifications may be made in the construction, arrangement, operation and method of construction of the portable golf ball washer disclosed herein without departing from the spirit and scope of the invention as defined in the following claims.

What is claimed is:

1. A portable washer for golf balls, comprising:

a generally hollow casing having an exterior wall surface, said exterior wall surface including a concave semi-spherical portion having a sphere diameter greater than the diameter of a golf ball;

a cleaning liquid reservoir comprising an upper portion of said hollow casing;

a closeable inlet aperture passing through said exterior wall surface for introducing cleaning liquid into said reservoir;

a fluid aperture passing through said concave semi-spherical portion into said reservoir for controllable discharge of said cleaning liquid from said reservoir;

a ball cleaning pad of stretchable, liquid absorbent material attached to said casing to overlay said concave semi-spherical portion in spaced relation thereto;

valve means cooperating with said fluid aperture for normally preventing liquid flow through said fluid aperture and actuatable to permit liquid flow through said fluid aperture; and a removable cap configured to be attached to said portable washer to cover said cleaning pad; wherein said removable cap is hingedly connected to said portable washer.

2. The portable washer of claim 1, wherein said valve means comprises a member normally sealingly pressed into said fluid aperture, said member openable for liquid flow through said fluid aperture by rearward pressure from a golf ball inserted and pushed into said cleaner pad, with the ball cleaning pad being in a spaced relation from the member when not being pushed by a golf ball.

3. The portable washer of claim 2, wherein said valve means comprises a spring having a spring head normally sealingly pressed into said fluid aperture.

4. The portable washer of claim 3, wherein said spring is formed of plastic.

5. The portable washer of claim 1, further comprising a retaining ring for surrounding said pad, with the concave semi-spherical portion including an outer periphery, with the retaining ring held in the outer periphery of the concave semi-spherical portion by a snap fit and maintaining said pad overlying said concave semi-spherical portion.

6. The portable golf ball washer of claim 1 wherein the removable cap is hingedly connected to said portable washer on the opposite side of the removable cap from the closeable inlet aperture.

7. Portable washer for golf balls having a diameter comprising, in combination: a hollow housing defining a reservoir for containing cleaning liquid and including a front face, a rear face, and a closeable inlet for introducing cleaning liquid into the reservoir; a fluid aperture passing through the front face and into the reservoir for controllable discharge of the cleaning liquid from the reservoir; a ball cleaning pad of liquid absorbent material attached to the hollow housing to overlay the front face and the fluid aperture passing through the front face, with the ball cleaning pad having a size less than the size of the front face; a cap of a size larger than the size of the ball cleaning pad but smaller than the size of the front face; and a hinge secured to the hollow housing and the cap for rotating the cap from a first position to a use position, with the cap in the first position abutting with the front face and covering the ball cleaning pad for reducing evaporation of the cleaning liquid and for preventing the pad from unwanted contact, with the cap in the use position allowing the golf ball to be pressed into the ball cleaning pad for applying cleaning liquid onto the golf ball, with the cap in the first position abutting with the front face of the hollow housing outside of the ball cleaning pad.

8. The portable golf ball washer of claim 7 wherein the front face is generally parallel to the rear face, with the rear face being flat.

9. The portable golf ball washer of claim 8 further comprising, in combination: an attachment clip attached to the rear face for clipping to the belt of golfer.

10. The portable golf ball washer of claim 9 wherein discharge of cleaning liquid from the reservoir through the fluid aperture to the ball cleaning pad is controlled during cleaning of the golf ball and prevented at other times.

11. The portable golf ball washer of 10 wherein the discharge of cleaning liquid through the fluid aperture is controlled by a valve including a head extending through the fluid aperture and utilizing the fluid aperture as a valve seat, with the head being biased to seal the fluid aperture against liquid flow therethrough and being pushable by the golf ball into the reservoir allowing liquid flow through the fluid aperture and past the head.

12. The portable golf ball washer of claim 11 wherein the rear face has an inside surface inside of the reservoir; and wherein the head is biased by a spring extending between the head and the inside surface of the rear face.

13. The portable golf ball washer of claim 9 wherein the hollow housing includes a front housing portion and a rear housing portion, with the front housing portion including the front face and a rearwardly extending perimeter edge, with the rear housing portion including the rear face and a forwardly extending perimeter edge matching the rearwardly extending perimeter edge of the front housing portion.

14. The portable golf ball washer of claim 13 wherein the perimeter edges of the front and rear housing portions include a sealed lap joint to prevent leakage of the cleaning liquid from the reservoir.

15. The portable golf ball washer of claim 9 wherein the closeable inlet is located in the hollow housing intermediate the front and rear faces; and wherein the cap in the first position is located intermediate the closeable inlet and the hinge.

16. The portable golf ball washer of claim 15 wherein the clip is secured to the rear face intermediate the closeable inlet and the hinge and extends therefrom away from the closeable inlet and terminates in a free end.

17. The portable golf ball washer of claim 7 wherein the front face includes a concave semi-spherical portion having a sphere diameter greater than the diameter of the golf ball, with the ball cleaning pad being stretchable and attached to the housing to overlay the concave semi-spherical portion in spaced relation thereto.

18. The portable golf ball washer of claim 17 wherein the concave semi-spherical portion includes an outer peripheral and wherein the portable golf ball washer further comprises, in combination: a fastening ring compressively mounted over the ball cleaning pad against the outer periphery of the concave semi-spherical portion to retain the ball cleaning pad and snapped into the outer periphery of the concave semi-spherical portion.

19. The portable golf ball washer of claim 7 further comprising, in combination: male support pegs having enlarged heads projecting outwardly from the front face, with the ball cleaning pad including attachment holes matching the male support pegs, with the ball cleaning pad being attached to the hollow housing by aligning the attachment holes with the male support pegs and pressing the ball cleaning pad onto the male support pegs.

20. The portable golf ball washer of claim 7 further comprising, in combination: a detent projecting from the front face, with the cap snapping onto the detent in the first position.

* * * * *

UNITED STATES PATENT AND TRADEMARK OFFICE
CERTIFICATE OF CORRECTION

PATENT NO. : 5,641,232

DATED : June 24, 1997

INVENTOR(S) : Michael C. Frey

It is certified that error appears in the above-identified patent and that said Letters Patent is hereby corrected as shown below:

Column 5, line 62, before "golfer" insert --the--.

Column 6, line 3, before "10" insert --claim--.

Column 6, line 43, cancel "peripheral" and substitute therefor --periphery;--.

Signed and Sealed this

Twenty-third Day of September, 1997

*Attest:*

Bruce Lehman

BRUCE LEHMAN

*Attesting Officer*

*Commissioner of Patents and Trademarks*